United States Patent [19]

Neta

[11] Patent Number: 4,562,659

[45] Date of Patent: Jan. 7, 1986

[54] AUTOMATIC FIREARM

[76] Inventor: Yoave Neta, Havzle St 21, 55000 Kiron, Israel

[21] Appl. No.: 535,999

[22] Filed: Sep. 26, 1983

[51] Int. Cl.[4] ..... F41C 5/02; F41D 5/04

[52] U.S. Cl. ..... 42/75 C; 89/172; 89/191.02; 42/71 R

[58] Field of Search ..... 42/71 R, 18, 75 C; 89/33.1, 172, 191 R, 191 A

[56] References Cited

U.S. PATENT DOCUMENTS

| | | | |
|---|---|---|---|
| 1,340,127 | 5/1920 | Welch | 42/71 R |
| 1,386,247 | 8/1921 | Fordyce | 42/71 R |
| 2,655,837 | 10/1953 | Johnson, Jr. | 89/172 |
| 3,429,223 | 2/1969 | Seccombe | 89/172 |
| 3,736,839 | 6/1973 | Childers | 89/33.03 |

FOREIGN PATENT DOCUMENTS

| | | | |
|---|---|---|---|
| 475011 | 11/1937 | United Kingdom | 42/71 R |

*Primary Examiner*—Charles T. Jordan
*Assistant Examiner*—Ted L. Parr
*Attorney, Agent, or Firm*—Joseph R. Marcus

[57] ABSTRACT

An improved automatic firearm. The firearm comprises a body assembly including a body member, a barrel mounted in said body member, a trigger assembly mounted to said body member proximate to the front end of the barrel, and a magazine guide in the body member spaced apart from and behind the trigger assembly. In addition, the body member suitably comprises a one-piece body cut to length.

20 Claims, 7 Drawing Figures

AUTOMATIC FIREARM

BACKGROUND OF THE INVENTION

This invention is concerned with weapons such as guns and more particularly with improved automatic firearms.

Automatic firearms enable the user to fire a number of rounds in quick succession. All of the functions of firing and reloading are performed by the weapon itself. That is withdrawing of the bolt, extracting a fresh cartridge, ejecting the spent cartridge case, forcing the bolt forward and inserting a fresh cartridge into the chamber are performed automatically. The energy of performing these functions is provided either by: the "blowback" force of the cartridge, the recoil or reaction forces of the cartridge and moving parts of the gun, the gas used to eject the projectile from the cartridge or combinations thereof. In any case it is the desire of the designers of such weapons to provide reliably operating guns that are relatively accurate, easy to handle, safe to use and that can readily be field stripped. Short guns are easy to handle. However, a problem with relatively short guns is that the barrel is relatively short and therefore accuracy is diminished. The designers of such weapons are continuously striving to obtain a relatively short gun for providing ease of handling but having a relatively long barrel for accuracy and penetrating power.

To decrease the manufacturing costs and to improve the reliability and ease of field stripping of automatic firearms, such as rifles, it is necessary that such weapons have as few moving parts as possible and certainly a minimum of external moving parts. For example, the usual gas operated automatic guns necessarily have moving parts not found in blowback or recoil operated types of automatic weapons since the gas operated weapons require the use of gas pistons.

The weapon designers for the noted reasons constantly strive to provide automatic weapons with a minimum number of parts. It is also a goal to provide guns that can easily be field stripped for maintenance purposes.

Accordingly, it is an object of the present invention to provide a new and improved automatic firearm in which the above-referred to disadvantages are substantially reduced or overcome and the above-referred to features are substantially provided.

SUMMARY OF THE INVENTION

According to the present invention an improved automatic firearm is provided. The firearm comprises a body assembly including body means, barrel means within the body means, trigger assembly means mounted to the body means proximate to the front end of the barrel means, and magazine guide means in the body means spaced apart from and behind the trigger assembly. In addition, the body means preferably comprises a one-piece body cut to length.

A feature of the invention provides means for using the barrel as a gas-operated piston.

Another feature of the invention includes extractor means that comprises a bolt carrier which operates rearwardly against a bolt return or drive spring. The carrier serves as a bolt carrier, an extractor, an ejector and in cooperation with the bolt as a firing pin actuator, thus minimizing the number of parts.

Still another feature of the invention comprises means for locking and unlocking the bolt to and from the barrel. Such means comprises means for rotating the bolt during backward movement of the bolt and for unlocking the bolt from the barrel and further rotating the bolt in its forward movement for locking the bolt to the barrel. The locking means includes means for enabling the firing pin responsive to said locking.

Yet another feature of the invention is the unique one-piece drawn body used to economically fabricate automatic firearms.

The operation and utilization of the present invention will become more fully apparent from the description of a preferred embodiment taken in conjunction with the accompanying drawings, in which:

DETAILED DESCRIPTION OF THE PREFERRED EMBODIMENT

Figure 1:
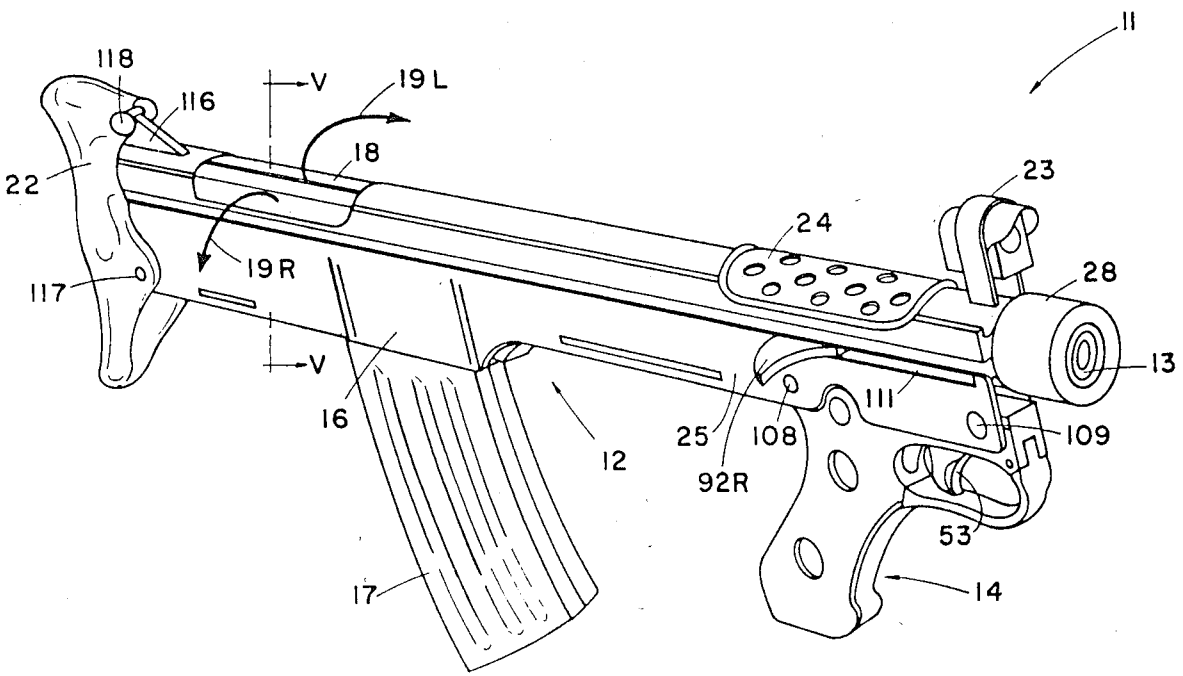
FIG. 1 is a perspective view of a preferred embodiment of the improved automatic firearm.

The improved automatic firearm 11 shown in the drawing of FIG. 1 as an automatic gun comprises a body assembly 12 having a barrel 13 with a trigger and hand grip assembly 14 mounted at the front end of the automatic gun 11. The trigger and hand grip assembly 14 may be any trigger and hand grip assembly well known to those skilled in the art. The important thing is that it is mounted proximate to the front end of the barrel 13.

The body assembly 12 is shown as further including a magazine guide section 16 holding a magazine 17 therein. A bolt 18 is shown as locked in place in the breech open position. The arrows 19R and 19L indicate that the spent cartridges can be ejected either to the right or the left depending on which side the deflector plate 20 is mounted (see FIG. 5). The deflector plate 20 is mounted to the gun body by any well known means such as fastener 29L in threaded hole 31L for right-hand deflection. Hole 31 is used to mount plate 20 for left-hand deflection. The magazine guide 16 is located underneath the chamber to decrease the length of the body 25.

Figure 2:
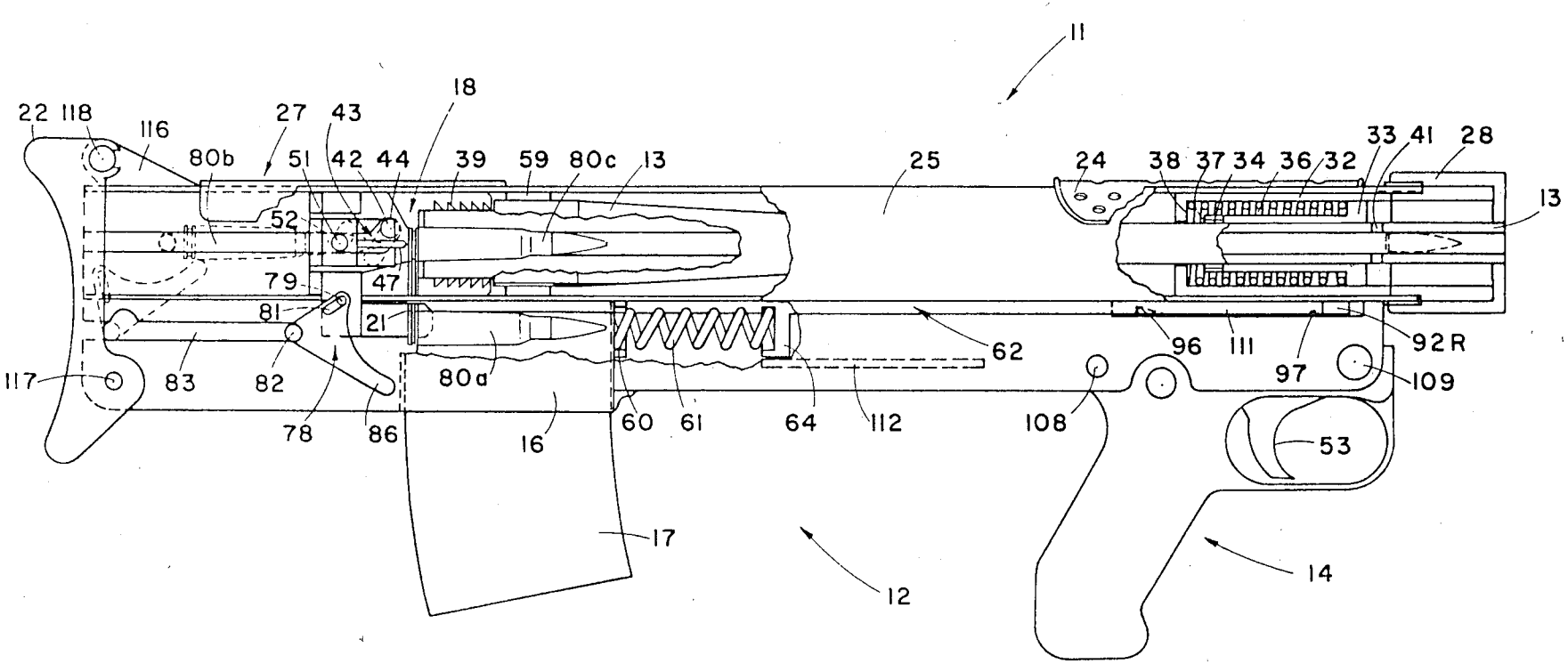
FIG. 2 is a partially sectioned view of the firearm of FIG. 1.

In a preferred embodiment the magazine 17 is of the type that is not open at the top but rather dispenses cartridges through an opening shown at 21 in FIG. 2 at the rear of the magazine. This avoids the jamming problems encountered when using open top magazines. The jamming is especially prevalent after use and wear when the tops of the magazines are bent.

Mounted to the rear of the body 25 is a butt 22 without any stock. Thus the body itself serves as the stock with the distance between the butt 22 and the handle and trigger assembly 14 being long enough so that the user of the gun can comfortably put the butt to his shoulder, aim through the sight assembly 23 and fire in the manner normally done when using a rifle having a stock and a butt with the trigger means closer to the rear end of the rifle.

A foregrip or handle section 24 is shown at the top of body 25 and towards the front thereof. The foregrip enables gripping and steadying the gun when firing from the shoulder or from the hip. The receiver portion 27 of the body covers the bolt assembly including the firing pin, the extractor and the ejector. At the front of the gun the barrel retaining nut 28 is shown which removably couples the barrel 13 to the body 25.

Thus in FIG. 2 note that a relatively long barrel is used and the gun is still short. This advantage is obtained by placing the trigger at the front end of the barrel and placing a butt at the rear end of the gun body so that there is sufficient room between the butt and the trigger for comfortable firing of the gun as a rifle.

Means are provided for displacing barrel 13 rearwardly responsive to firing of the gun. More particularly as gas cylinder 32, best seen in FIG. 2, is provided. Note that the barrel itself acts as a gas-operated piston. A piston 33 fixedly attached to the barrel 13 at 34, forces the barrel 13 to move backwards responsive to backward motion of the piston 33. The piston operates against a barrel return spring 36. The spring 36 resists the initial recoil forces applied to the barrel and therefore absorbs those forces to significantly reduce the recoil impact effect on the gun user. Note that the distance that the piston can move is relatively short. It is the distance from the end 37 of the piston 33 to the inside-end 38 of the gas cylinder 32. This distance however, provides enough motion to enble unlocking the bolt 18 from the barrel 13. When the bullet 40 passes gas ports such as port 41, gas at high pressure enters the gas cylinder and forces the piston and barrel rearwardly. When the piston reaches the end of its travel it also brakes the rearward movement of the barrel. At this time the bolt 18 located in receiver portion 27 is unlocked from the barrel.

Means such as discontinuous threads 39 (FIGS. 2 and 4A) are provided for locking the bolt 18 to the barrel 13. The number 39 of course indicates threads both on the barrel and the bolt. The threads have longitudinal gaps therein so that when the bolt turns relative to the barrel unlocking is enabled. When the bolt is unlocked from the barrel, the bolt which is not braked is forced backward and the breech is opened.

Figure 4:
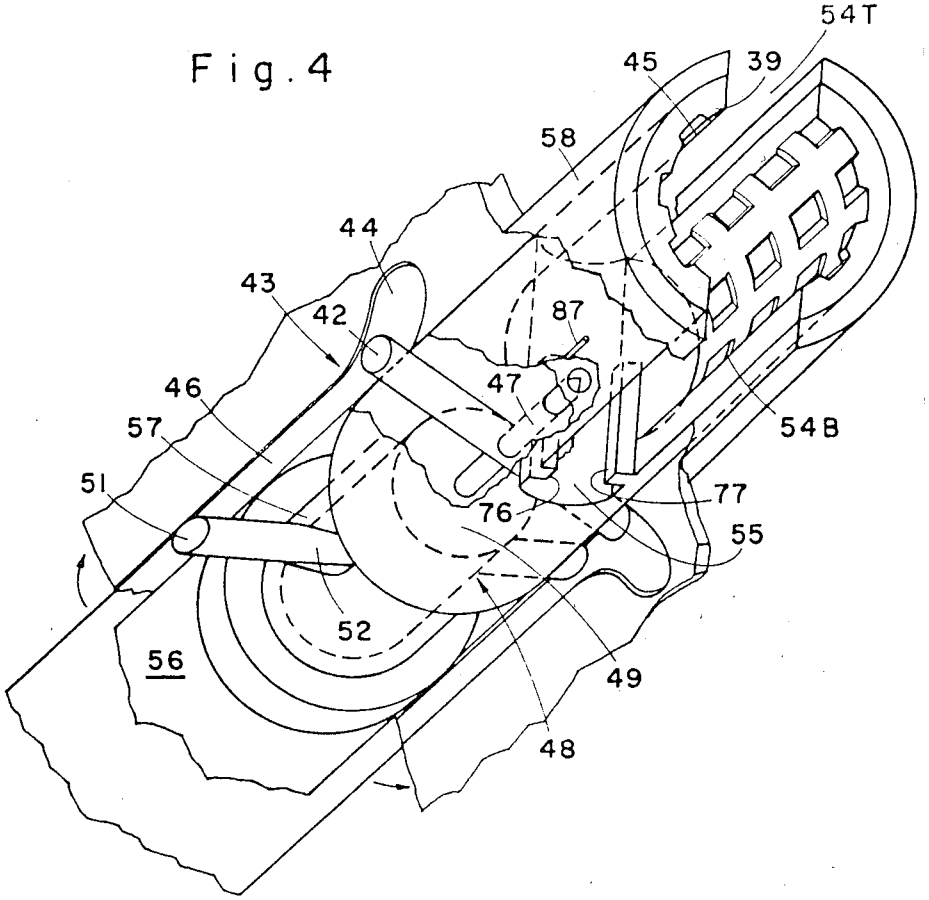
FIG. 4 is a partially broken away perspective view of the bolt assembly of the firearm of FIG. 1.

Means are provided for turning the bolt relative to the barrel. The means include a bolt rotation control pin 42 extending from the bolt assembly 18 into a characterized groove 43 in the body of the gun. The characterized groove terminates in substantially a biased angle section 44. More particularly a portion 44 of the groove 43 is at an angle to the longitudinal axis of the gun. The other portion 46 of the groove 43 is parallel to the axis or the barrel of the gun (see FIG. 4). As the bolt rotation actuation pin 42 which is fixedly attached to the body of the bolt moves in the groove it rotates the bolt thereby locking and unlocking the bolt from the barrel. As shown in FIG. 4 the firing pin 47 of the firing pin assembly 48 passes through a hole in bolt rotation actuation pin 42. The firing pin assembly 48 includes firing pin 47 as well as the main body 49 of the firing pin. Note that for reasons of clarity FIG. 4 does not show the bolt carrier 62.

Means are provided for moving the bolt assembly forward to enable the firing of the cartridge in the compartment. More particularly a firing pin control pin 51 is fixedly attached to the firing pin body 49. Pin 51 passes through a diagonal groove 52 in the bolt. Pin 51 rides in the parallel portion 46 of the groove 43 in the body of the automatic gun. The diagonal nature of the groove 52 assures longitudinal movement of the firing pin assembly during the rotation of the bolt. The longitudinal movement of the bolt assembly 18 moves the firing pin assembly 48 by the forces on pin 51. The locked longitudinal movement of the firing pin and bolt assures that the cartridge is not fired until the bolt is locked closing the breech. At that time the firing pin impacts the cartridge and fires the bullet.

As shown especially in FIG. 4 the bolt assembly has a raised rear section 56 separated by a circumferentially grooved section 57 from a raised forward section 58. The circumferential groove receives an attaching portion of a bolt carrier means. The raised forward section 58 includes the hollow portion having the threads 39 with gaps 45 therein for interconnecting and locking with the barrel of the gun. The hollow forward portion 58 of the bolt has longitudinal gaps 54B and 54T therein which enable cartridges to pass there through for loading and ejecting purposes, respectively.

The bolt assembly 18 is forced backward responsive to the gas pressures on the barrel until it rotates and is unlocked from the barrel. Then the recoil forces initiated by the firing of the bullet maintain the backward motion of the bolt after it is unlocked.

Note that the barrel 13 is prevented from rotating by means such as keyed ring 59 (see FIG. 2). Any other well known means can be used to keep the barrel from rotating.

The initial force of the gas is absorbed by spring 36. Then the barrel-bolt combination starts travelling rearwardly. The pin 42 is located at this time juxtaposed to the front of groove 44. The groove 44 is wide enough to provide a time lag before the pin hits the back of groove 44 and starts turning the bolt for the unlocking action.

Figure 3:
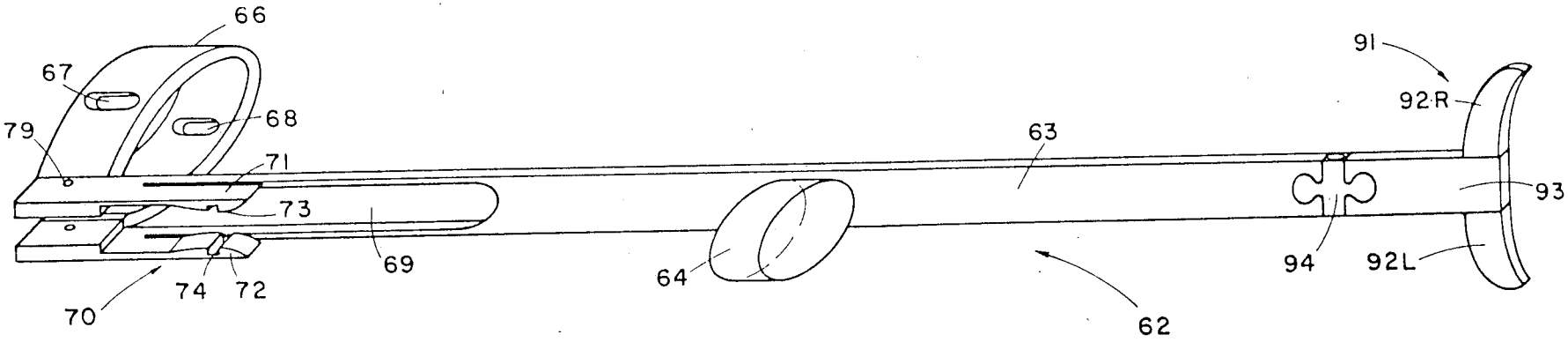
FIG. 3 is a perspective view of the bolt carrier of the improved automatic firearm.

The bolt is returned to its forward position by a drive spring 61 acting on a bolt carrier means 62 (FIGS. 2 and 3).

The bolt carrier means 62 comprises a beam portion 63. Appended to the longitudinal beam portion and extending perpendicularly therefrom is a drive spring retaining member 64 keyed to portion 63, in any well known manner.

The rear end of the carrier comprises an attaching portion such as bolt coupling member 66. The bolt coupling member 66 is a circular member designed to receive the peripheral groove 57 of the bolt slip-fitted therein. Note that the bolt coupling member 66 includes grooves 67 and 68 which enable longitudinal motion of actuation pin 51. The pin 51 extends from the firing pin body 49 through grooves such as groove 52 in the bolt and grooves 67 and 68 in the carrier to ride in the parallel portions such as portion 46 of groove 43.

A gap 69 in the longitudinal beam 63 enables cartridges to pass from the magazine to the chamber. Extractor means 70 are provided for extracting the cartridges from the magazine. More particularly a pair of extracting fingers 71 and 72 are shown. These fingers extend from the bottom of the bolt coupling member 66. The fingers 71 and 72 are shaped to form cartridge grippers 73 and 74, respectively, designed to fasten onto the rear of the top cartridge in the magazine. The cartridge grippers 73 and 74 are aligned with cartridge grippers 76 and 77 in the bolt.

Means are provided for ejecting the case of the spent cartridge and replacing it with a new cartridge. More particularly an ejector lever 78 is shown in FIG. 2 coupled to bolt coupling member 66 of bolt carrier 62. The coupling comprises pin means 79 which extends through a groove 81 in the ejector lever 78. The lever 78 moves the length of an ejector control groove or track 83 and pivots around a track pin 82.

When the pin 82 reaches its rearmost position abutting against a portion of butt 22, then the force of the continuing backward movement of the bolt and the bolt carrier cause the lever 78 to rotate around pin 82. The pin 79 in groove 81 enables the lever 78 to move to the dotted line position shown in FIG. 2 with forward portion 86 of the lever 78 having moved from a position removed from the bolt, through an arc to a position shown in dashed line form in contact with the cartridge held by the bolt. During this movement lever 78 pushes a cartridge shown as cartridge 80*a* from between the cartridge grippers 73 and 74 of the cartridge to a position 80*b* between the cartridge grippers 76 and 77 of the bolt. During this movement the new cartridge forces the spent case out of the open breech.

Figure 4A:
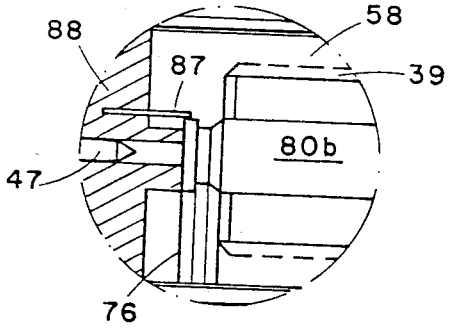
FIG. 4A is an enlarged view showing a mounted cartridge.

Means are provided for enabling the ejection of the spent cartridge case and retaining the new cartridge in the bolt. More particularly as shown in FIGS. 4 and 4A, this means comprises a cantilevered pin 87 that extends from the breech block 88 of the bolt 58 above the cartridge grippers 76 and 77. The pin spring 87 is sufficiently resilient to enable the spent cartridge to be ejected and sufficiently rigid to assure stoppage of the replacement cartridge. Note that the lever portion 86 as shown in FIG. 2, extends upward a sufficient amount to eject the last cartridge case against the retaining force of pin spring 87.

The drive spring 61 at this point is in the fully compressed position between a spring cup 60 and retainer 64 and acts on the carrier to force the carrier and the bolt assembly including the firing pin forward. The movement of the bolt assembly forward places the new cartridge shown at 80*c* into the breech with the firing pin in position for firing. With the trigger 53 operated the pin strikes the cartridge on the return of the bolt and fires to renew the cycle.

Means are provided for manually arming the gun. More particularly bolt handle assembly 91 is coupled to the end of the bolt carrier assembly. The handle assembly comprises a pair of handles 92R and 92L for use by right-handed or left-handed people, respectively. The handles extend from handle body 93. The handle body is attached to the carrier assembly 62 by any well known easily removable means such as key 94.

The carrier assembly 62 with the handle attached provides the means for enabling the trigger 53 to control the operation of the gun. More particularly with the trigger 53 in the unoperated position a pair of sears 96 and 97 protrude upwardly to inhibit movement of the bolt carrier assembly 62. When the breech is closed with the bolt in the position shown in FIG. 2, then sear 97 prevents the bolt from being pulled back to the armed position. The spring 61 is in its normal uncompressed state.

When the trigger is operated the sears 96 and 97 then move downward to enable the bolt handles to be used to pull back the bolt carrier and bolt. If the trigger is then released the sear 96 locks the bolt handle assembly 91 behind the sear 96 holding the bolt in a rearward position with the breech open as shown in FIG. 1. In this position the spring 61 is compressed and provides the necessary energy to fire the gun if the trigger 53 is operated and a cartridge is in the bolt. Note that the gun does not hold a round in the chamber.

Rounds are placed in the chamber only as part of the actual firing process. Thus, this is an "open-pants" type gun and accordingly avoids uncontrolled firing due to "cooking".

Figure 5:
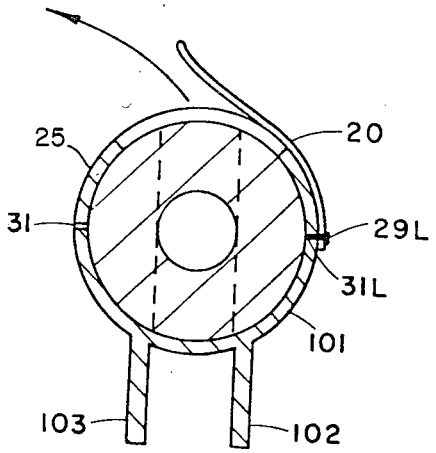
FIG. 5 is sectional view showing a cartridge deflector.
Figure 6:
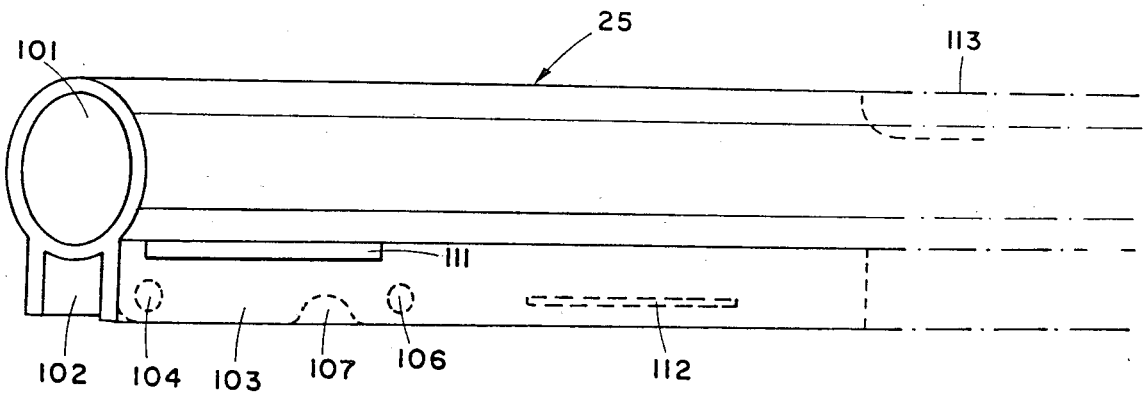
FIG. 6 is a perspective view of a drawn firearm body used in the preferred embodiment of FIG. 1.

A unique feature of the automatic firearm 11 is the one-piece gun body 25 shown at FIG. 5 and FIG. 6. The body 25 is drawn and then cut to the proper lengths. The body 25 comprises a round barrel retaining portion and the downward extending spaced apart longitudinal legs 102 and 103. The legs are used for mounting parts to the gun body.

For example, after the body 5 is cut to the proper length various cutting and forming operations are performed. Apertures 104 and 106 as well as notch 107 are cut to be used for mounting the handle and trigger assembly. The assembly 14 is mounted to the body using a fastener 108 and a pivot pin 109. To strip the gun the fastener 108 is removed and the handle and trigger assembly pivoted aside (downward) around pin 109.

A groove 111 is cut through the legs 102 and 103 to enable the movement of the bolt handles 92R and 92L. Simultaneously an indentation 112 provides a track for spring retainer 64 to assure stable movement of the bolt carrier 62.

A breech opening is machined in the top of the body and a magazine holder section is formed for receiving the magazine.

In a preferred embodiment of the automatic weapon few parts are fixedly attached to the unique body. For example, a wedge 116 is attached to the body by any well known means such as welding. The wedge 116 is used for attaching the butt 22 to the body 25. More particularly a fastener 117 and a pivot pin 118 couple the butt to the body of the gun.

In operation a magazine such as magazine 17 is placed into the magazine guide 16 in the body 12 of the automatic rifle 11. The bolt is pulled back where it is locked in place in any well known manner such as explained immediately hereinabove. The breech is in the open position with the cartridge now held by the grippers 76 and 77 of the bolt. The cartridge shown at 80*b* which has been extracted from the magazine has been pushed up to the bolt grippers by the ejector lever 78.

The spring 61 is fully compressed and retained between the bolt carrier retainer cup 64 and the rifle body retainer cup 60. The user of the gun places the butt 22 against his shoulder and sights along the barrel through sight 23, for example, until he has the target in view. When the target is in view he operates trigger 53 which enables the spring 61 to force the bolt carrier 62 forward. The bolt carrier moves forward with the bolt. The bolt rotation actuation pin 42 slides in the characterized groove 43 in the body of the rifle. When pin 42 reaches the diagonal portion 44 of the groove then it causes the bolt to rotate. At this time the bolt overlaps the barrel and locks in place. At the same time the groove 52 in the bolt actuates the firing control pin 51 longitudinally forward without rotative motion. The control pin 51 also extends through aperture 67 and slides in the characterized groove 43. The firing pin hits the detonator firing the cartridge. The initial recoil forces are absorbed by spring 36. As the bullet of the cartridge speeds down the barrel it passes the gas ports such as port 41, enabling the gas to enter the gas cylinder assembly 32 and act on the piston 33 to cause the barrel to be forced backward. Since at this time the bolt is attached to the barrel, it too is forced backwards. As the bolt is forced backwards, the bolt rotation actuation pin 42 is forced backward. Initially pin 42 moves from the front of the diagonal portion 44 of groove 43 to the rear thereof. When it is juxtaposed to the rear of groove 44 it causes the bolt to rotate and unlatch from the barrel. The bolt turns within the bolt coupling member which fits loosely around the peripheral groove 57. The bolt and bolt carrier member attached thereto keep moving backwards after the bolt is unlocked from the barrel. The barrel 13 is forced to its forward position by spring 36.

During the backward movement of the bolt carrier member 62 the extractor 70 extracts the next round (80*a*) from the magazine. The ejector lever 78 forces that round up into the bolt (as at 80*b*), ejecting the spent cartridge case. If the trigger remains pulled there is nothing to stop the bolt under the force of the drive spring 61 from being forced forward into the chamber (80*c*) where it is detonated and the cycle repeated.

Thus a short automatic firearm with a comparatively long barrel is provided with a minimum of moving parts that operate automatically in a rapid firing mode. Because of the minimal number of moving parts as described herein the rifle is reliable under severest of ambient conditions. It is short and light and therefore easy to handle. A preferred embodiment of the firearm is fabricated from a unique drawn body cut to length. It can serve either right-handed or left-handed users by selectively attaching the same deflector plate. It is also contemplated within the scope of this invention that this improved firearm can be operated as a belt fed machine gun, if desired.

While the principles of the invention have been described above in connection with specific apparatus and application, it is to be understood that this description is made by way of example only and not as a limitation on the scope of the invention.

I claim:

1. An improved automatic firearm comprising:

a body assembly including body means comprising a one-piece drawn body cut to length, barrel means mounted in said body means, trigger assembly means mounted to said body means proximate to the front end of said barrel means, and magazine guide means in said body means spaced apart from and behind said trigger assembly means and being adapted to receive a magazine carrying cartridges therein.

2. The improved automatic firearm of claim 1, wherein said body assembly has a short stockless butt attached to the rear end of said body means.

3. The improved automatic firearm of claim 1, wherein said barrel means is actuated rearwardly to perform gas operated piston functions responsive to gases of a fired cartridge.

4. The improved firearm of claim 1, including means for absorbing initial recoil forces.

5. An improved automatic firearm comprising:

a body assembly including body means comprising a one-piece body cut to length, barrel means mounted in said body means, trigger assembly means mounted to said body means proximate to the front end of said barrel means, magazine guide means in said body means spaced apart from and behind said trigger assembly means and being adapted to receive a cartridge magazine therein, bolt means, bolt carrier means attached to said bolt means, said bolt carrier means comprising extractor means for extracting cartridges from said magazine, said bolt means and bolt carrier means moving rearwardly responsive to forces on said barrel means caused by firing said firearm, bolt forward moving means for moving said bolt means forward after said bolt means reaches the end of rearward movement, means for locking and unlocking said bolt means to and from said barrel means responsive to forward and rearward movement of said bolt means, respectively, and firing pin means attached to said bolt means for firing cartridges in a chamber when said bolt means is locked to said barrel means.

6. The improved automatic firearm of claim 5, wherein said bolt carrier means includes ejector means for ejecting a spent cartridge, said ejector means being actuated responsive to said carrier means reaching a rearmost position.

7. The improved automatic firearm of claim 6, including deflector plate means attached to one side of a breech opening in said firearm for deflecting an ejected spent cartridge, said deflector plate means being shaped to deflect an ejected spent cartridge either to the left or to the right depending on which side of said breech opening of said firearm said deflector plate means is mounted.

8. The improved automatic firearm of claim 5, wherein said locking and unlocking means comprises means for rotating said bolt means responsive to linear movement thereof.

9. The improved automatic firearm of claim 5, wherein said locking and unlocking means comprises a groove in said body means of said firearm and pin means on said bolt means, said groove being adapted to cause rotation of said bolt means.

10. The improved automatic firearm of claim 5, including means for enabling said firing pin means to fire a cartridge only after said bolt means is locked to said barrel means.

11. The improved automatic firearm of claim 10, wherein said firing pin enabling means comprises control pin means extending from said firing pin means through grooves in said bolt means, said grooves in said bolt means acting on said firing pin means to force said firing pin means against a cartridge only when said bolt means is in a locked position.

12. An improved automatic firearm comprising:

a body assembly including body means, said body means comprising a one-piece body cut to length, barrel means mounted in said body means, said barrel means being actuated rearwardly to perform gas operated piston functions responsive to gases of a fired cartridge, trigger assembly means mounted to said body means proximate to the front end of said barrel means, magazine guide means in said body means spaced apart from and behind said trigger assembly means and being adapted to receive a magazine carrying cartridge therein, bolt means having bolt carrier means attached thereto, said bolt carrier means comprising extractor means for extracting cartridges from said magazine, said bolt means and bolt carrier means moving rearwardly responsive to forces on said barrel means caused by firing said firearm, bolt forward moving means for moving said bolt means forward after said bolt means reaches the end of rearward movement, means for locking and unlocking said bolt means to and from said barrel means responsive to forward and rearward movement of said bolt means, respectively, and firing pin means attached to said bolt means for firing cartridges in a chamber when said bolt means is locked to said barrel means.

13. The improved automatic firearm of claim 12, wherein said bolt carrier means includes ejector means for ejecting a spent cartridge, said ejector means being actuated responsive to said bolt carrier means reaching a rearmost position, said locking and unlocking means comprising means for rotating said bolt means responsive to linear movement thereof.

14. The improved automatic firearm of claim 13, wherein said locking and unlocking means comprises a groove in said body means of said firearm and pin means on said bolt means, said groove being adapted to cause rotation of said bolt means.

15. The improved automatic firearm of claim 14, including means for enabling said firing pin means to fire a cartridge only after said bolt means is locked to said barrel means.

16. The improved automatic firearm of claim 15, wherein said firing pin enabling means comprises control pin means extending from said firing pin means through grooves in said bolt means, said grooves in said bolt means acting on said firing pin means to force said firing pin means against a cartridge only when said bolt means is in a locked position.

17. The improved automatic firearm of claim 16, including deflector plate means attached to one side of a breech opening in said firearm for deflecting an ejected spent cartridge, said deflector plate means being shaped to deflect an ejected spent cartridge either to the left or to the right depending on which side of said breech opening of said firearm said deflector plate means is mounted.

18. An improved automatic firearm comprising:

a body assembly including body means, said body means comprising a one-piece drawn body cut to length, said body assembly having a short stockless butt attached to the rear end of said body means, barrel means mounted in said body means, said barrel means being actuated rearwardly to perform gas operated piston functions responsive to gases of a fired cartridge, trigger assembly means mounted to said body means proximate to the front end of said barrel means, magazine guide means in said body means spaced apart from and behind said trigger assembly means and being adapted to receive a magazine carrying cartridge therein, bolt means having bolt carrier means attached thereto, said bolt carrier means comprising extractor means for extracting cartridges from said magazine, said bolt carrier means including ejector means for ejecting a spent cartridge, said bolt means and bolt carrier means moving rearwardly responsive to forces on said barrel means caused by firing said firearm, said ejector means being actuated responsive to said bolt carrier means reaching a rearmost position, bolt forward moving means for moving said bolt means forward after said bolt means reaches said rearmost position, means for locking and unlocking said bolt means to and from said barrel means responsive to forward and rearward movement of said bolt means, respectively, said locking and unlocking means comprising means for rotating said bolt means responsive to linear movement thereof, said bolt means rotating means comprising a groove in said body means of said firearm and pin means on said bolt means, means for enabling said firing pin means to fire a cartridge only after said bolt means is locked to said barrel means, said firing pin enabling means comprising control pin means extending from said firing pin means through grooves in said bolt means, said grooves in said bolt means acting on said firing pin means to force said firing pin means against a cartridge only when said bolt means is in a locked position.

19. The improved automatic firearm of claim 18, including deflector plate means attached to one side of a breech opening in said firearm for deflecting an ejected spent cartridge, said deflector plate means being shaped to deflect an ejected spent cartridge either to the left or to the right depending on which side of said breech opening of said firearm said deflector plate means is mounted.

20. The improved automatic firearm of claim 19 including means for absorbing initial recoil forces.

* * * * *

UNITED STATES PATENT AND TRADEMARK OFFICE

CERTIFICATE OF CORRECTION

PATENT NO. : 4,562,659

DATED : January 7, 1986

INVENTOR(S) : Yoave Neta

It is certified that error appears in the above-identified patent and that said Letters Patent is hereby corrected as shown below:

Column 5, line 36, "the" should be -- its --.

Column 6, line 16, "5" should be -- 25 --.

Column 7, line 59, after "improved" insert -- automatic --.

Signed and Sealed this

Fourteenth Day of October, 1986

[SEAL]

*Attest:*

DONALD J. QUIGG

*Attesting Officer*

*Commissioner of Patents and Trademarks*